US012656015B2

(12) United States Patent
Wei

(10) Patent No.: US 12,656,015 B2
(45) Date of Patent: Jun. 16, 2026

(54) CONTROL METHOD FOR AIR CONDITIONER AND AIR CONDITIONER BY CONTROLLING A COMPRESSOR AT DIFFERENT FREQUENCY RATES BASED ON A CORNER FREQUENCY

(71) Applicants: FOSHAN SHUNDE MIDEA ELECTRIC SCIENCE AND TECHNOLOGY CO., LTD., Foshan (CN); GD MIDEA AIR-CONDITIONING EQUIPMENT CO., LTD., Foshan (CN)

(72) Inventor: Liuzhu Wei, Foshan (CN)

(73) Assignees: FOSHAN SHUNDE MIDEA ELECTRIC SCIENCE AND TECHNOLOGY CO., LTD., Foshan (CN); GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 452 days.

(21) Appl. No.: 18/322,351

(22) Filed: May 23, 2023

(65) Prior Publication Data

US 2023/0296280 A1 Sep. 21, 2023

Related U.S. Application Data

(63) Continuation of application No. PCT/CN2021/102178, filed on Jun. 24, 2021.

(30) Foreign Application Priority Data

Dec. 31, 2020 (CN) ..... 202011635150.1

(51) Int. Cl.

| | |
|---|---|
| ***F24F 11/86*** | (2018.01) |
| *F24F 110/10* | (2018.01) |
| *F24F 110/20* | (2018.01) |

(52) U.S. Cl.
CPC ..... *F24F 11/86* (2018.01); *F24F 2110/10* (2018.01); *F24F 2110/20* (2018.01)

(58) Field of Classification Search
CPC .... F24F 11/86; F24F 2110/10; F24F 2110/20; F24F 11/48; F24F 2120/10; F24F 11/64;
(Continued)

(56) References Cited

U.S. PATENT DOCUMENTS 5,323,619 A 6/1994 Kim
10,941,951 B2 * 3/2021 Hern ..... F24F 1/08
(Continued)

FOREIGN PATENT DOCUMENTS

CN 104949263 A 9/2015
CN 106766376 A 5/2017
(Continued)

OTHER PUBLICATIONS

Written Opinion of the International Searching Authority dated Sep. 27, 2021 received in International Application No. PCT/CN2021/102178.

(Continued)

*Primary Examiner* — Alicia M. Choi
(74) *Attorney, Agent, or Firm* — Scully, Scott, Murphy & Presser, P.C.

(57) ABSTRACT

Provided are a control method for an air conditioner and an air conditioner. The control method includes: determining a corner frequency of a compressor based on a target frequency of the compressor and a minimum operating frequency of the compressor; determining, based on the corner frequency, a first rate and a second rate of frequency-raising of the compressor; and controlling the compressor to start up, the compressor performing the frequency-raising at the first rate when a current operating frequency of the compressor is smaller than the corner frequency, and the com-
(Continued)

pressor performing the frequency-raising at the second rate when the current operating frequency of the compressor is greater than or equal to the corner frequency. The first rate is greater than the second rate.

13 Claims, 10 Drawing Sheets

(58) Field of Classification Search
CPC ..... F24F 2120/00; F24F 11/88; F24F 11/30; F25B 49/025; F25B 2600/0253; F25B 2700/02; F25B 2700/2104; F25B 2700/21152; F25B 49/022; Y02B 30/70
See application file for complete search history.

(56) References Cited

U.S. PATENT DOCUMENTS

| | | | | |
|---|---|---|---|---|
| 2020/0056934 | A1* | 2/2020 | Parker | B81B 7/0061 |
| 2020/0318846 | A1* | 10/2020 | Salsbury | F24F 11/80 |

FOREIGN PATENT DOCUMENTS

| | | | | | |
|---|---|---|---|---|---|
| CN | 107631430 | A | * | 1/2018 | F25B 49/02 |
| CN | 107631443 | A | | 1/2018 | |
| CN | 107702281 | A | | 2/2018 | |
| CN | 107860161 | A | | 3/2018 | |
| CN | 109341013 | A | | 2/2019 | |
| CN | 109708246 | A | | 5/2019 | |
| CN | 109708259 | A | | 5/2019 | |
| CN | 111256321 | A | | 6/2020 | |
| CN | 111336643 | A | | 6/2020 | |
| CN | 111503841 | A | | 8/2020 | |
| CN | 107631430 | B | | 9/2020 | |
| CN | 112032979 | A | | 12/2020 | |
| CN | 112762582 | A | | 5/2021 | |
| CN | 113310168 | A | * | 8/2021 | F24F 11/88 |
| CN | 118856544 | A | * | 10/2024 | F24F 11/65 |

OTHER PUBLICATIONS

Supplementary European Search report dated Apr. 9, 2024 received in European Patent Application No. EP 21912950.9.
International Search Report dated Sep. 27, 2021 received in International Application No. PCT/CN2021/102178.
Office Action dated Dec. 31, 2021 received in Chinese Patent Application No. 202011635150.1.
Office Action dated Jun. 14, 2022 received in Chinese Patent Application No. 202011635150.1.
Notice of Allowance dated Dec. 2, 2022 received in Chinese Patent Application No. 202011635150.1.

* cited by examiner

CONTROL METHOD FOR AIR CONDITIONER AND AIR CONDITIONER BY CONTROLLING A COMPRESSOR AT DIFFERENT FREQUENCY RATES BASED ON A CORNER FREQUENCY

CROSS-REFERENCE TO RELATED APPLICATIONS

The present application a continuation of International Application No. PCT/CN2021/102178, filed on Jun. 24, 2021, which claims priority to and benefits of Chinese Patent Application No. 202011635150.1 field on Dec. 31, 2020, the entire contents of each of which are incorporated herein by reference for all purposes. No new matter has been introduced.

FIELD

The present disclosure relates to the field of air conditioning technologies, and in particular, to a control method for an air conditioner and an air conditioner.

BACKGROUND

In related technologies, after an air conditioner is turned on, longer time is required for a frequency-raising of a compressor to a predetermined frequency, resulting in a long startup time for the compressor. As a result, the air conditioner would perform refrigeration within a longer time after starting up. Especially for the air conditioner installed in a kitchen, the temperature in the kitchen would still high even after the air conditioner has started up for a long time, which may significantly affect a user's comfort.

SUMMARY

The present disclosure proposes a control method for an air conditioner, which can shorten a startup time of a compressor and improve a user's comfort.

The present disclosure also proposes an air conditioner, which is capable of operating based on the control method for the air conditioner described above.

The control method for the air conditioner according to embodiments of the present disclosure includes: determining a corner frequency of a compressor based on a target frequency of the compressor and a minimum operating frequency of the compressor; determining, based on the corner frequency, a first rate and a second rate of frequency-raising of the compressor; and controlling the compressor to start up, the compressor performing the frequency-raising at the first rate when a current operating frequency of the compressor is smaller than the corner frequency, and the compressor performing the frequency-raising at the second rate when the current operating frequency of the compressor is greater than or equal to the corner frequency. The first rate is greater than the second rate.

In the control method for the air conditioner according to the embodiments of the present disclosure, when the current operating frequency of the compressor is smaller than the corner frequency, the compressor is in a low-and-medium frequency operating state, and an air conditioner system has a relatively low pressure when the compressor operates at a low-and-medium frequency. In this case, the frequency-raising can be performed at a faster first rate. When the current operating frequency of the compressor is greater than the corner frequency, the compressor is in a high frequency operating state, and the air conditioner system has a relatively high pressure when the compressor operates at a high frequency. In this case, the frequency-raising can be performed at a slower second rate. In this way, the startup time of the compressor can be shortened while the air conditioner system is ensured to operate safely and stably. Therefore, the operating frequency of the compressor can be promptly increased to the target frequency, thereby realizing a rapid adjustment of an indoor temperature, which in turn improves a user's comfort.

In some embodiments of the present disclosure, the control method for the air conditioner further includes: detecting an indoor ambient temperature and an indoor relative humidity; determining a target apparent temperature of a user based on the indoor ambient temperature and the indoor relative humidity; and determining the target frequency based on the indoor ambient temperature and the target apparent temperature.

In some embodiments of the present disclosure, the corner frequency is half of a sum of the target frequency and the minimum operating frequency.

In some embodiments of the present disclosure, the control method for the air conditioner includes a detection operation, which includes: detecting an exhaust temperature of the compressor; calculating a change rate of the exhaust temperature; controlling, when the change rate of the exhaust temperature is greater than or equal to a first predetermined value, the compressor to operate at the current operating frequency as a temporary frequency for a predetermined duration; and controlling, when the change rate of the exhaust temperature is smaller than the first predetermined value, the compressor to further perform the frequency-raising at a current frequency-raising rate.

In some embodiments of the present disclosure, the first predetermined value ranges from 4 Celsius degrees per second to 8 Celsius degrees per second.

In some embodiments of the present disclosure, the predetermined duration ranges from 50 seconds to 70 seconds.

In some embodiments of the present disclosure, the control method for the air conditioner further includes, subsequent to the detection operation: determining whether the current operating frequency is greater than or equal to the corner frequency; controlling, in response to determining that the current operating frequency is greater than or equal to the corner frequency, the compressor to further perform the frequency-raising at the second rate; and controlling, in response to determining that the current operating frequency is smaller than the corner frequency, the compressor, the compressor to further perform the frequency-raising at the first rate.

In some embodiments of the present disclosure, the control method for the air conditioner further includes: obtaining a change rate of an apparent temperature of a human body; determining whether the change rate of the apparent temperature is greater than or equal to a second predetermined value; controlling, in response to determining that the change rate of the apparent temperature is greater than or equal to the second predetermined value, the compressor to further perform the frequency-raising at a third rate, the third rate being smaller than the current frequency-raising rate; and controlling, in response to determining that the change rate of the apparent temperature is smaller than the second predetermined value, the compressor to further perform the frequency-raising at the current frequency-raising rate.

In some embodiments of the present disclosure, the second predetermined value ranges from 1 Celsius degree per second to 2 Celsius degrees per second.

In some embodiments of the present disclosure, the control method for the air conditioner further includes: detecting a real-time apparent temperature of a human body; determining whether the real-time apparent temperature is greater than or equal to a target apparent temperature; and enabling, in response to determining that the real-time apparent temperature is greater than or equal to the target apparent temperature, the compressor to further perform the frequency-raising at the current frequency-raising rate; and determining, in response to determining that the real-time apparent temperature is smaller than the target apparent temperature, the current operating frequency of the compressor as the target frequency of the compressor.

According to embodiments of the present disclosure, an air conditioner is provided, which is capable of operating based on the control method for the air conditioner as described above.

In the air conditioner according to the embodiments of the present disclosure, when a current operating frequency of the compressor is smaller than the corner frequency, the compressor is in a low-and-medium frequency operating state, and an air conditioner system has a relatively low pressure when the compressor operates at a low-and-medium frequency. In this case, the frequency-raising can be performed at a faster first rate. When the current operating frequency of the compressor is greater than the corner frequency, the compressor is in a high frequency operating state, and the air conditioner system has a relatively high pressure when the compressor operates at a high frequency. In this case, the frequency-raising can be performed at a slower second rate. In this way, the startup time of the compressor can be shortened while the air conditioner system is ensured to operate safely and stably. Therefore, the operating frequency of the compressor can be promptly increased to the target frequency, thereby realizing a rapid adjustment of an indoor temperature, which in turn improves a user's comfort.

Additional aspects and advantages of the present disclosure will be partially described in the following description, and some will become apparent from the following description, or learned through the practice of the present disclosure.

Figure 1:
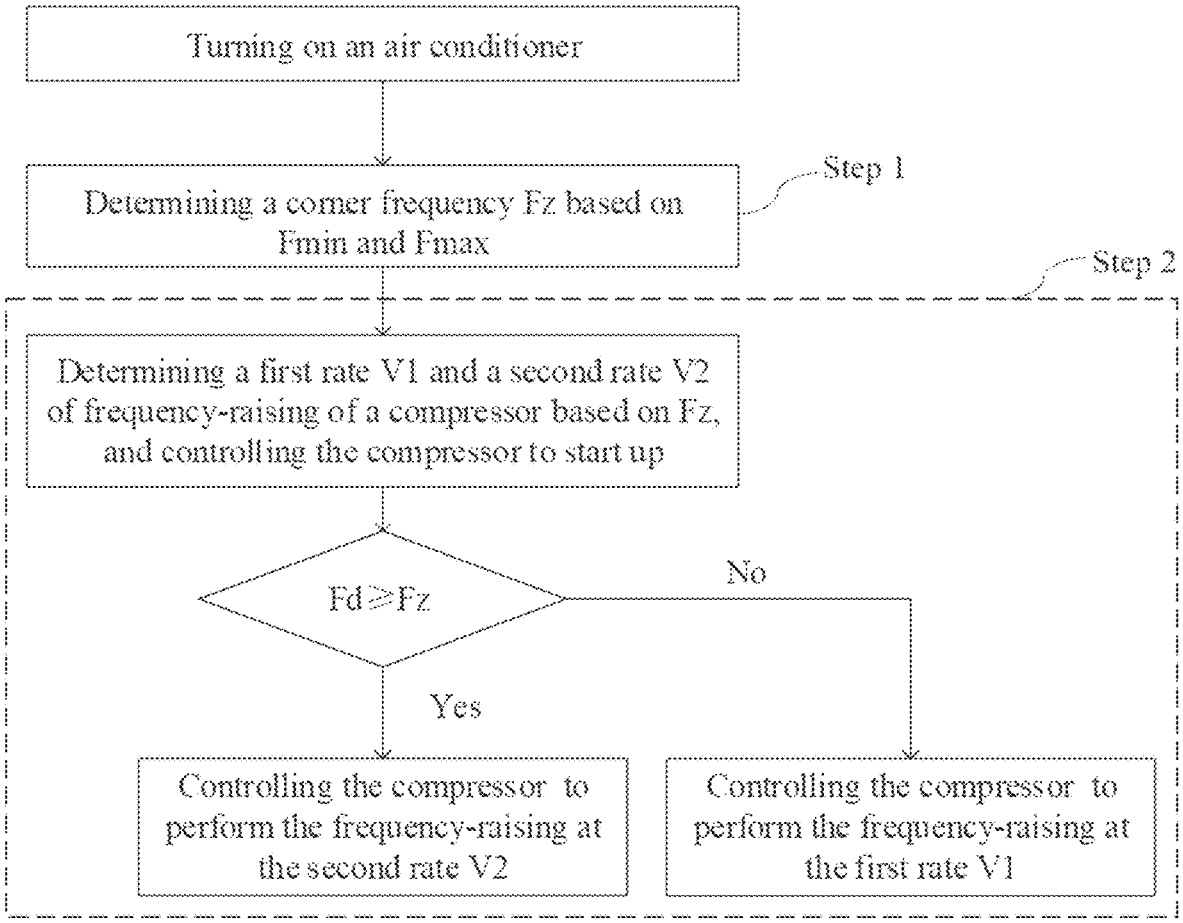
FIG. 1 is a flowchart of a control method for an air conditioner according to an embodiment of the present disclosure.

LISTING OF REFERENCE NUMERALS air conditioner 100 housing 1; accommodation space 10, first air inlet 11, first air outlet 12, second air inlet 13, second air outlet 14, evaporator: 2, condenser: 3, fan assembly 4, compressor 5, deflector 61, air inlet grille 62.

DESCRIPTION OF EMBODIMENTS

Embodiments of the present disclosure are described in detail below, and examples of embodiments are shown in the accompanying drawings, in which the same or similar labels throughout represent the same or similar components or components with the same or similar functions. The embodiments described below with reference to the accompanying drawings are illustrative and intended to be used to explain the present application, rather than being understood as limiting the application.

The following present disclosure provides many different embodiments or examples to implement the different structures of the present disclosure. In order to simplify the disclosure of the present disclosure, specific example components and settings are described below. Of course, they are only examples and are not intended to limit the present disclosure. In addition, the present disclosure may repeatedly refer to numbers and/or letters in different examples. This repetition is for the purpose of simplification and clarity and does not in itself indicate the relationship between the various embodiments and/or settings discussed. In addition, the present disclosure provides examples of various specific processes and materials, and those skilled in the art may be aware of the applicability of other processes and/or the use of other materials.

A control method for an air conditioner 100 according to an embodiment of the present disclosure will be described below with reference to the drawings.

As shown in FIG. 1, the control method of the air conditioner 100 according to an embodiment of the present disclosure includes determining a corner frequency Fz of a compressor 5 based on a target frequency Fmax of the compressor 5 and a minimum operating frequency Fmin of the compressor 5. It can be understood that a frequency-raising range of the compressor 5 may be determined based on the target frequency Fmax of the compressor 5 and the minimum operating frequency Fmin of the compressor 5. By determining the target frequency Fmax and the minimum operating frequency Fmin, it is possible to more accurately divide a low-and-medium frequency operating range and a high frequency operating range.

As shown in FIG. 1, a first rate and a second rate of frequency-raising of the compressor 5 is determined based on the corner frequency. The compressor 5 is controlled to start up. The compressor 5 performs the frequency-raising at the first rate when a current operating frequency Fd of the compressor 5 is smaller than the corner frequency. It should be understood that when the current operating frequency of the compressor 5 is smaller than the corner frequency, the compressor 5 is in a low-medium frequency operating state, and the air conditioner 100 has a relatively low pressure when the compressor 5 operates at a low-and-medium frequency. In this case, the frequency-raising can be performed at a faster first rate. Therefore, the operating frequency of the compressor 5 can be promptly increased to the target frequency while the air conditioner 100 is ensured to operate safely and stably, thereby shortening a duration required for the frequency-raising of the compressor 5 to the target frequency, i.e., shortening a startup time of the compressor 5. In some embodiments, the first rate is 1 Hz/s to 2 Hz/s.

As shown in FIG. 1, the compressor 5 can perform the frequency-raising at the second rate when the current operating frequency Fd of the compressor 5 is greater than the corner frequency. The first rate is greater than the second rate. It should be understood that when the current operating frequency of the compressor 5 is greater than the corner frequency, the compressor 5 is in a high frequency operating state, and the air conditioner 100 has a relatively high pressure when the compressor 5 operates at a high frequency. In this case, the frequency-raising can be performed at a slower second rate. Therefore, it is possible to ensure the air conditioner 100 to operate safely and stably throughout the frequency-raising of the compressor 5.

In some embodiments of the present disclosure, after the air conditioner 100 is turned on, the compressor 5 first performs the frequency-raising to the corner frequency at the first rate rapidly, and then performs the further frequency-raising to the target frequency at the second rate.

During the research, it was found that in the related art a frequency of a variable-frequency compressor may be divided into several different frequency intervals based on the variable-frequency range. When the compressor starts up, the compressor is required to operate within a predetermined duration in each predetermined frequency range from low to high frequencies, which may result in a longer startup time of the system, thereby affecting refrigeration capacity in a startup phase. In a typical air conditioning environment, such a slow startup method has less impact on a user's comfort. However, in a kitchen air conditioning environment, due to the high temperature of the kitchen environment, rapid cooling is required upon a user enters the kitchen. However, such the slower startup method is not suitable for the kitchen air conditioning.

Based on research and experimentations, it was found that it is possible for the control method for the air conditioner 100 according to the embodiments of the present disclosure to save half the time when the compressor performs the frequency-raising to the same target frequency when compared with the frequency-raising method in the related art.

Figure 7:
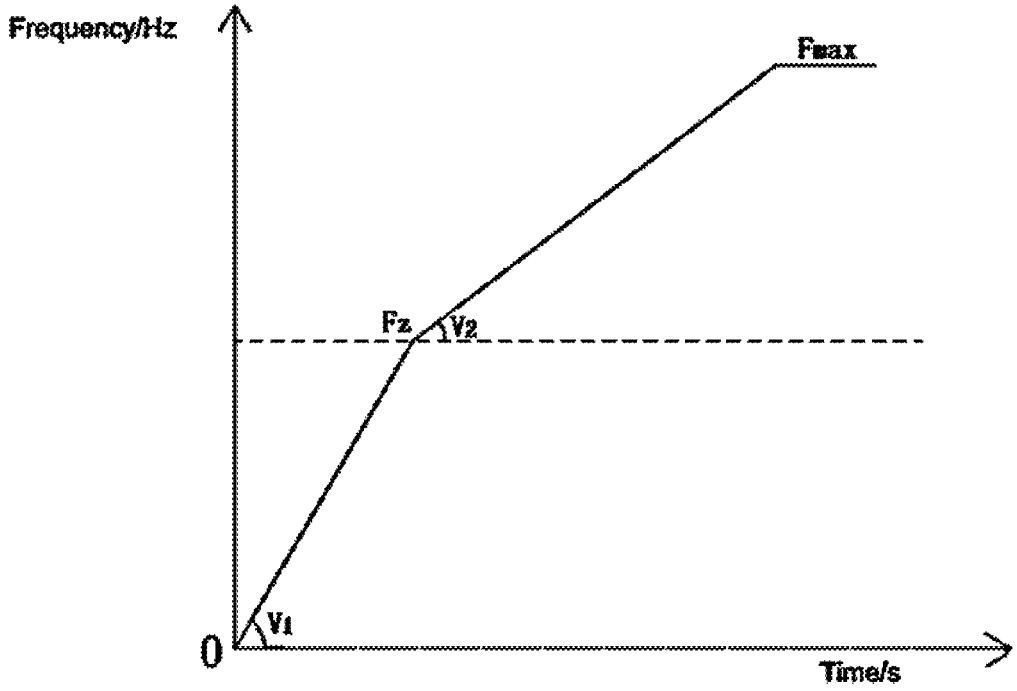
FIG. 7 is a frequency-raising broken line diagram for an air conditioner according to an embodiment of the present disclosure.

In one embodiment of the present disclosure, as shown in FIGS. 1 and 7, a control method for an air conditioner 100 includes operations at steps 1 and 2.

At step 1, a corner frequency Fz of a compressor 5 is determined based on a target frequency Fmax of the compressor 5 and a minimum operating frequency Fmin of the compressor 5.

At step 2, a first rate V1 and a second rate V2 of frequency-raising of the compressor 5 is determined based on the corner frequency Fz, and the compressor 5 is controlled to start up. The compressor 5 performs the frequency-raising at the first rate V1 when a current operating frequency Fd of the compressor is smaller than the corner frequency Fz, and the compressor performs the frequency-raising at the second rate V2 when the current operating frequency Fd of the compressor is greater than or equal to the corner frequency Fz.

In the control method for the air conditioner 100 according to the embodiments of the present disclosure, when the current operating frequency of the compressor 5 is smaller than the corner frequency, the compressor 5 is in a low-and-medium frequency operating state, and an air conditioner 100 has a relatively low pressure when the compressor 5 operates at a low-and-medium frequency. In this case, the frequency-raising can be performed at a faster first rate. When the current operating frequency of the compressor 5 is greater than the corner frequency, the compressor 5 is in a high frequency operating state, and the air conditioner 100 has a relatively high pressure when the compressor 5 operates at a high frequency. In this case, the frequency-raising can be performed at a slower second rate. In this way, the startup time of the compressor 5 can be shortened while the air conditioner 100 is ensured to operate safely and stably. Therefore, the operating frequency of the compressor 5 can be promptly increased to the target frequency, thereby realizing a rapid adjustment of an indoor temperature, which in turn improves a user's comfort.

Figure 2:
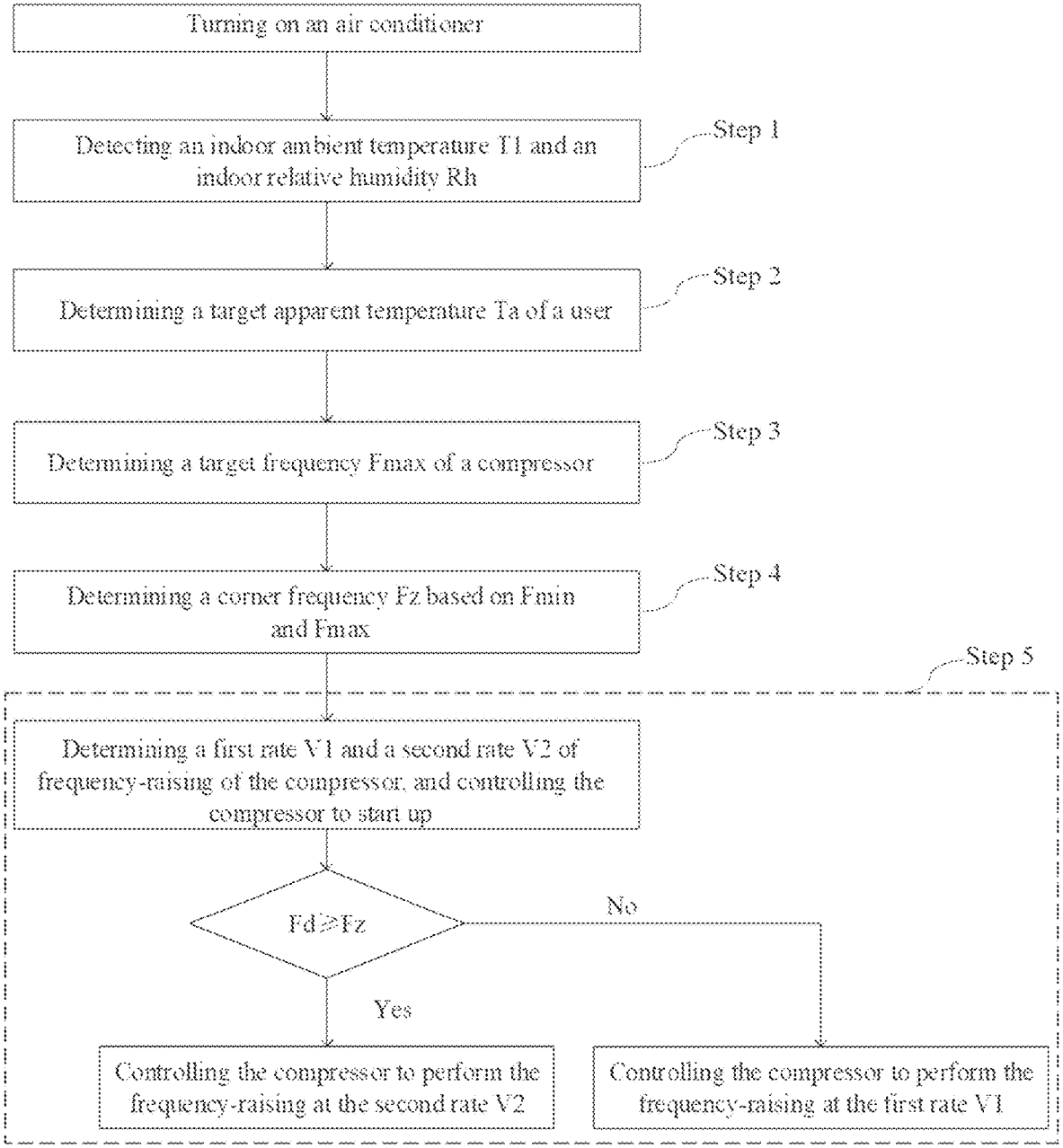
FIG. 2 is a flowchart of a control method for an air conditioner according to an embodiment of the present disclosure.

In some embodiments of the present disclosure, as shown in FIG. 2, the control method for the air conditioner 100 includes: detecting an indoor ambient temperature T1 and an indoor relative humidity Rh; determining a target apparent temperature Ta of a user based on the indoor ambient temperature T1 and the indoor relative humidity Rh; and determining a target frequency Fmax based on the indoor ambient temperature T1 and the target apparent temperature Ta.

It should be understood that the target apparent temperature Ta of the user is related to the indoor ambient temperature T1 and the indoor relative humidity Rh. A relatively comfortable target apparent temperature Ta may be calculated with the indoor ambient temperature T1 and the indoor relative humidity Rh. In some embodiments of the present disclosure, $Ta=T1-k1*(T1-k2)*(1-Rh)$, where k1 and k2 represent predetermined constants, and k1 and k2 are obtained experimentally.

In addition, the target frequency Fmax of the compressor 5 is related to the indoor ambient temperature T1 and the target apparent temperature Ta. A relatively accurate target frequency Fmax may be calculated with the indoor ambient temperature T1 and the target apparent temperature Ta. In this way, a temperature of the indoor space can be adjusted more accurately by the air conditioner 100.

In one embodiment of the present disclosure, as shown in FIG. 2, the control method for the air conditioner 100 includes steps 1 to 5.

At step 1, an indoor ambient temperature T1 and an indoor relative humidity Rh are detected.

At step 2, a target apparent temperature Ta of a user is determined based on the indoor ambient temperature T1 and the indoor relative humidity Rh.

At step 3, a target frequency Fmax is determined based on the indoor ambient temperature T1 and the target apparent temperature Ta.

At step 4, a corner frequency Fz of the compressor 5 is determined based on the target frequency Fmax of the compressor 5 and the minimum operating frequency Fmin of the compressor 5.

At step 5, a first rate V1 and a second rate V2 of frequency-raising of the compressor 5 are determined based on the corner frequency Fz, and the compressor 5 is controlled to start up. When the current operating frequency Fd of the compressor 5 is smaller than the corner frequency Fz, the compressor 5 is controlled to perform the frequency-raising at the first rate V1, and when the current operating frequency Fd of the compressor 5 is greater than or equal to the corner frequency Fz, the compressor 5 is controlled to perform the frequency-raising to the target frequency Fmax at the second rate V2.

Figure 6:
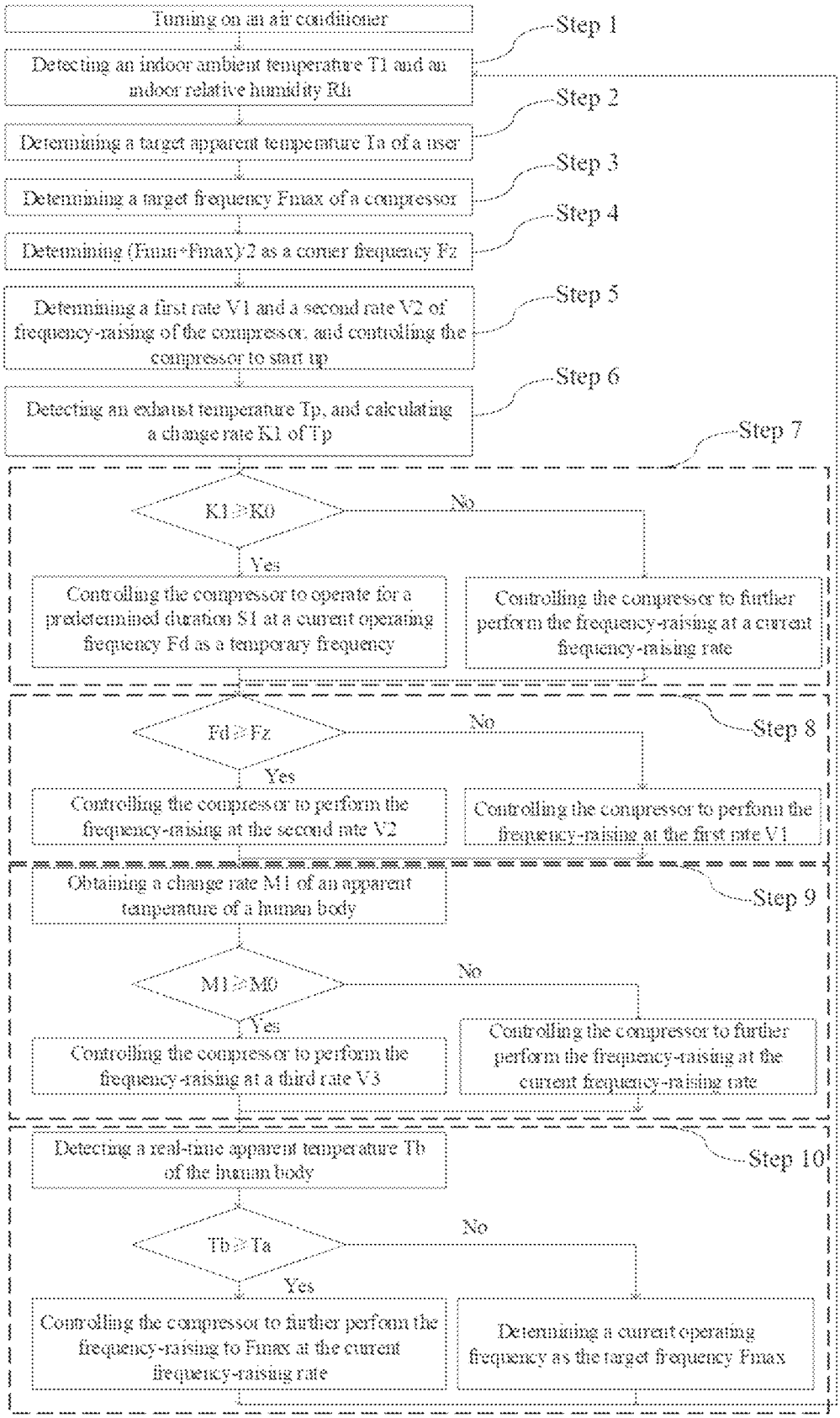
FIG. 6 is a flowchart of a control method for an air conditioner according to an embodiment of the present disclosure.

In some embodiments of the present disclosure, as shown in FIG. 6, the corner frequency Fz is half of a sum of the target frequency Fmax and the minimum operating frequency Fmin. Thus, complexity of the calculation of the corner rate can be simplified, thereby reducing calculation difficulty of the air conditioner 100. Meanwhile, probability of errors during the calculation can also be reduced. However, the present disclosure is not limited to this regard, and the corner frequency may also be set based on the model, power, and working environment of the air conditioner 100.

In one embodiment of the present disclosure, as shown in FIG. 6, a control method for an air conditioner 100 includes operations at steps 1 and 2.

At step 1, half of the sum of the target frequency Fmax of the compressor 5 and the minimum operating frequency Fmin of the compressor 5 is determined as the corner frequency Fz of compressor 5.

At step 2, when the current operating frequency Fd of compressor 5 is smaller than the corner frequency Fz, the compressor 5 is controlled to perform the frequency-raising at the first rate V1, and when the current operating frequency Fd of the compressor 5 is greater than the corner frequency Fz, the compressor 5 is controlled to perform the frequency-raising to the target frequency at the second rate V2.

Figure 3:
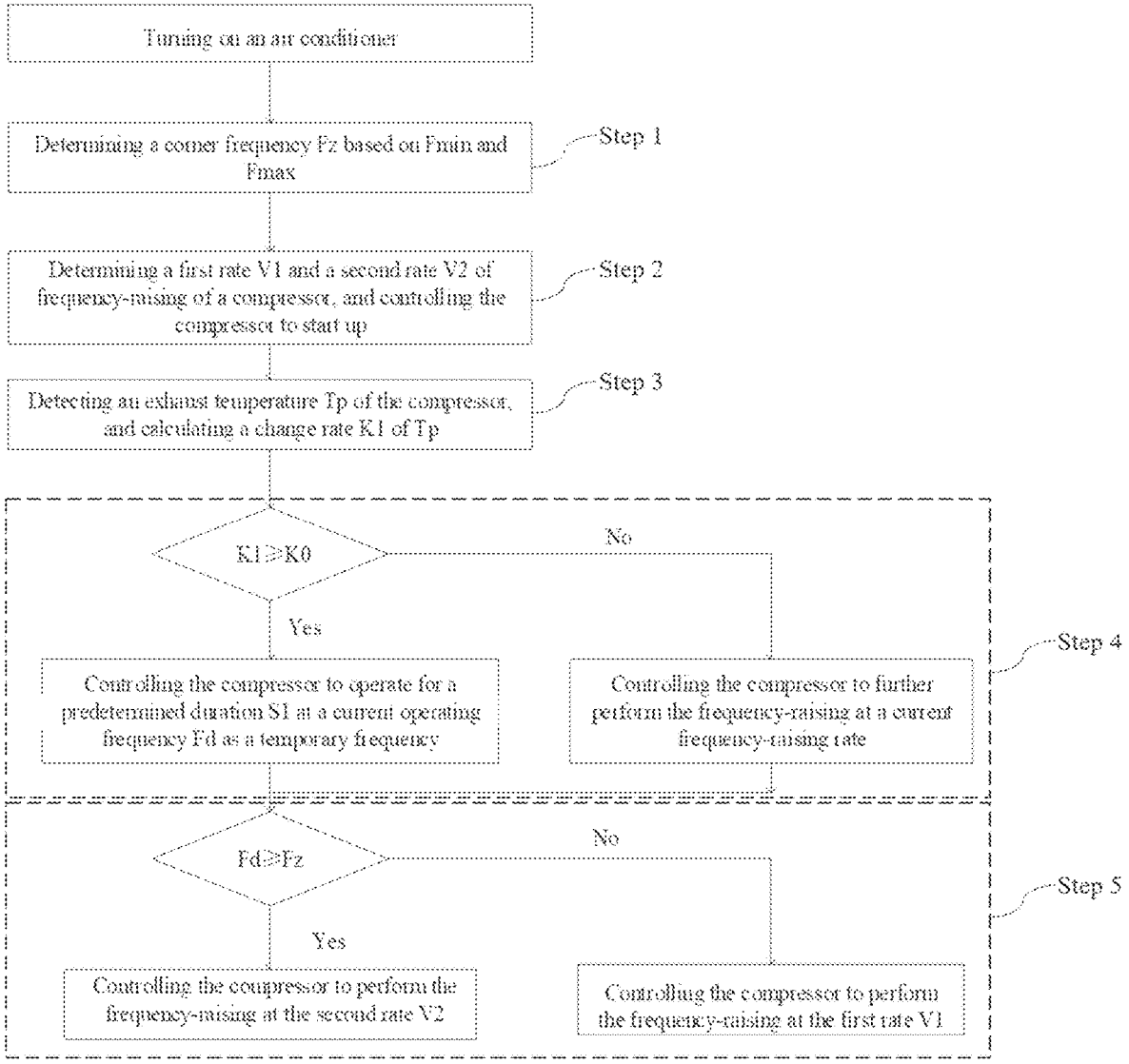
FIG. 3 is a flowchart of a control method for an air conditioner according to an embodiment of the present disclosure.
Figure 8:
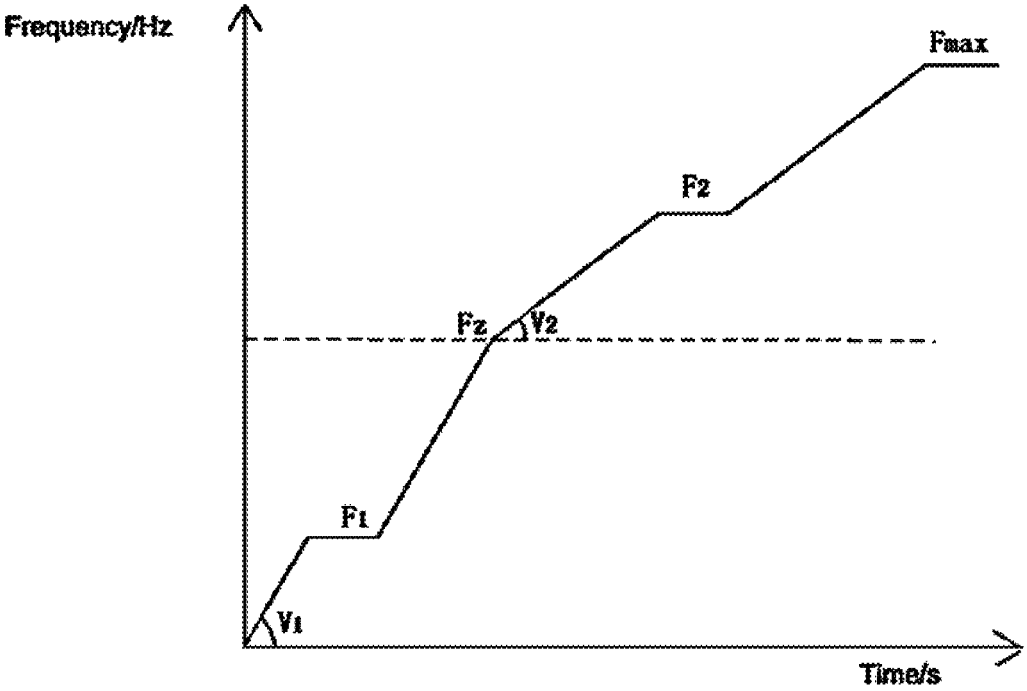
FIG. 8 is a frequency-raising broken line diagram of an air conditioner according to another embodiment of the present application.

In some embodiments of the present disclosure, as shown in FIGS. 3 and 8, the control method for the air conditioner 100 also includes a detection step of: detecting an exhaust temperature Tp of the compressor 5; calculating a change rate K1 of the exhaust temperature; controlling, when the change rate K1 of the exhaust temperature is greater than or equal to a first predetermined value K0, the compressor 5 to operate for a predetermined duration 51 at the current operating frequency Fd as a temporary frequency; and controlling, when the change rate K1 of the exhaust temperature is smaller than the first predetermined value K0, the compressor 5 to further perform the frequency-raising at a current frequency-raising rate.

It can be understood that since the frequency adjustment of the compressor 5 has a relatively direct impact on the exhaust temperature, if K1 is greater than or equal to K0, it is indicated that the exhaust temperature of the compressor 5 rises too fast, and it is difficult for the air conditioner 100 to balance stably. Therefore, the compressor 5 operates for the predetermined duration S1 at the current operating frequency Fd as the temporary frequency, in order for the compressor 5 to operate stably for the predetermined duration to enhance stability of the system. Otherwise, it is indicated that the system operates stably, and the compressor 5 can maintain the current operation.

It should be noted that the current frequency-raising rate described above is the first or second rate at which the compressor is performing the frequency-raising. For example, in a frequency-raising stage where the frequency-raising rate of the compressor 5 is the first rate, when the change rate of the exhaust temperature is greater than or equal to the first predetermined value, the compressor 5 is controlled to operate for the predetermined duration S1 at the current operating frequency Fd as the temporary frequency, and when the change rate of the exhaust temperature is smaller than the first predetermined value, the compressor 5 is controlled to further perform the frequency-raising at the first rate. For another example, in a frequency raising stage where the frequency-raising rate of the compressor 5 is the second rate, when the change rate of the exhaust temperature is greater than or equal to the first predetermined value, the compressor 5 is controlled to operate for the predetermined duration S1 at the current operating frequency Fd as the temporary frequency, and when the change rate of the exhaust temperature is smaller than the first predetermined value, the compressor 5 is controlled to further perform the frequency-raising at the second rate.

In some embodiments of the present disclosure, the first predetermined value K0 ranges from 4 Celsius degrees per second to 8 Celsius degrees per second. It can be understood ranging the first predetermined value K0 from 4 Celsius degrees per second to 8 Celsius degrees per second can more accurately determine whether the air conditioner 100 is in a stable operating state. For example, in some examples of the present disclosure, the first predetermined value K0 may be 4 Celsius degrees per second, 5 Celsius degrees per second, 6 Celsius degrees per second, 7 Celsius degrees per second, or 8 Celsius degrees per second. In some embodiments of the present disclosure, the first predetermined value K0 can be selected and set based on the model of the air conditioner 100 and its operating environment.

In some embodiments of the present disclosure, the predetermined duration S1 ranges from 50 seconds to 70 seconds. It should be understood that the compressor 5 can operate at the temporary frequency for 50 seconds to 70 seconds by setting the predetermined duration S1 to range from 50 seconds to 70 seconds. Thus, it is possible to provide a more suitable stabilization time for the stability of the compressor 5. For example, in some examples of the present disclosure, the predetermined duration S1 may be 50 seconds, 55 seconds, 60 seconds, 65 seconds, or 70 seconds. In one embodiment of the present disclosure, the predetermined duration S1 may be selected and set based on the model of the air conditioner 100 and its operating environment.

In some embodiments of the present disclosure, as shown in FIG. 3, the control method for the air conditioner 100 further includes, subsequent to the detection step: determining whether the current operating frequency Fd is greater than or equal to the corner frequency Fz; in response to determining that the current operating frequency Fd is greater than or equal to the corner frequency Fz, controlling the compressor 5 to further perform the frequency-raising at the second rate; and in response to determining that the current operating frequency Fd is smaller than the corner frequency Fz, controlling the compressor 5 to further perform the frequency-raising at the first rate.

It can be understood that after compressor 5 operates for the predetermined duration S1 at the current operating frequency Fd as the temporary frequency, the air conditioner 100 is already in the stable state, or when the exhaust temperature change rate of the compressor 5 is smaller than the first predetermined value, the air conditioner 100 is also in the stable state. At this time, it is necessary to further determine whether the compressor 5 needs to perform the frequency-raising at the first rate or the second rate. In one embodiment, if the current operating frequency Fd is greater than or equal to the corner frequency Fz, it is indicated that the compressor 5 is in the high frequency operating state. In this case, the compressor 5 is controlled to perform the frequency-raising at the second rate. If the current operating frequency Fd is smaller than the corner frequency Fz, it is indicated that the compressor 5 is in the low-and-medium frequency operating state. In this case, the compressor 5 is controlled to perform the frequency-raising at the first rate.

In one embodiment of the present disclosure, as shown in FIGS. 3 and 8, a control method for an air conditioner 100 includes operations at steps 1 to 5.

At step 1, a corner frequency Fz of a compressor 5 is determined based on a target frequency Fmax of the compressor 5 and a minimum operating frequency Fmin of the compressor 5.

At step 2, a first rate V1 and a second rate V2 of frequency-raising of the compressor 5 is determined based on the corner frequency Fz, and the compressor 5 is controlled to start up.

At step 3, an exhaust temperature Tp of the compressor 5 is detected, and a change rate K1 of the exhaust temperature is calculated.

At step 4, when the change rate K1 of the exhaust temperature is greater than or equal to the first predetermined value K0, the compressor 5 is controlled to operate for the predetermined duration S1 at the current operating frequency Fd as a temporary frequency, and when the change rate K1 of the exhaust temperature is smaller than the first predetermined value K0, the compressor 5 is controlled to further perform the frequency-raising at the current frequency-raising rate.

At step 5, it is determined whether the current operating frequency Fd is greater than or equal to the corner frequency Fz. In response to determining that the current operating frequency Fd is greater than or equal to the corner frequency Fz, the compressor 5 is controlled to perform the frequency-raising to the target frequency Fmax at the second rate V2, and in response to determining that the current operating frequency Fd is smaller than the corner frequency Fz, the compressor 5 is controlled to perform the frequency-raising at the first rate V1. When the operating frequency of the compressor 5 is greater than the corner frequency Fz, the compressor 5 is controlled to perform the frequency-raising at the second rate V2.

Figure 4:
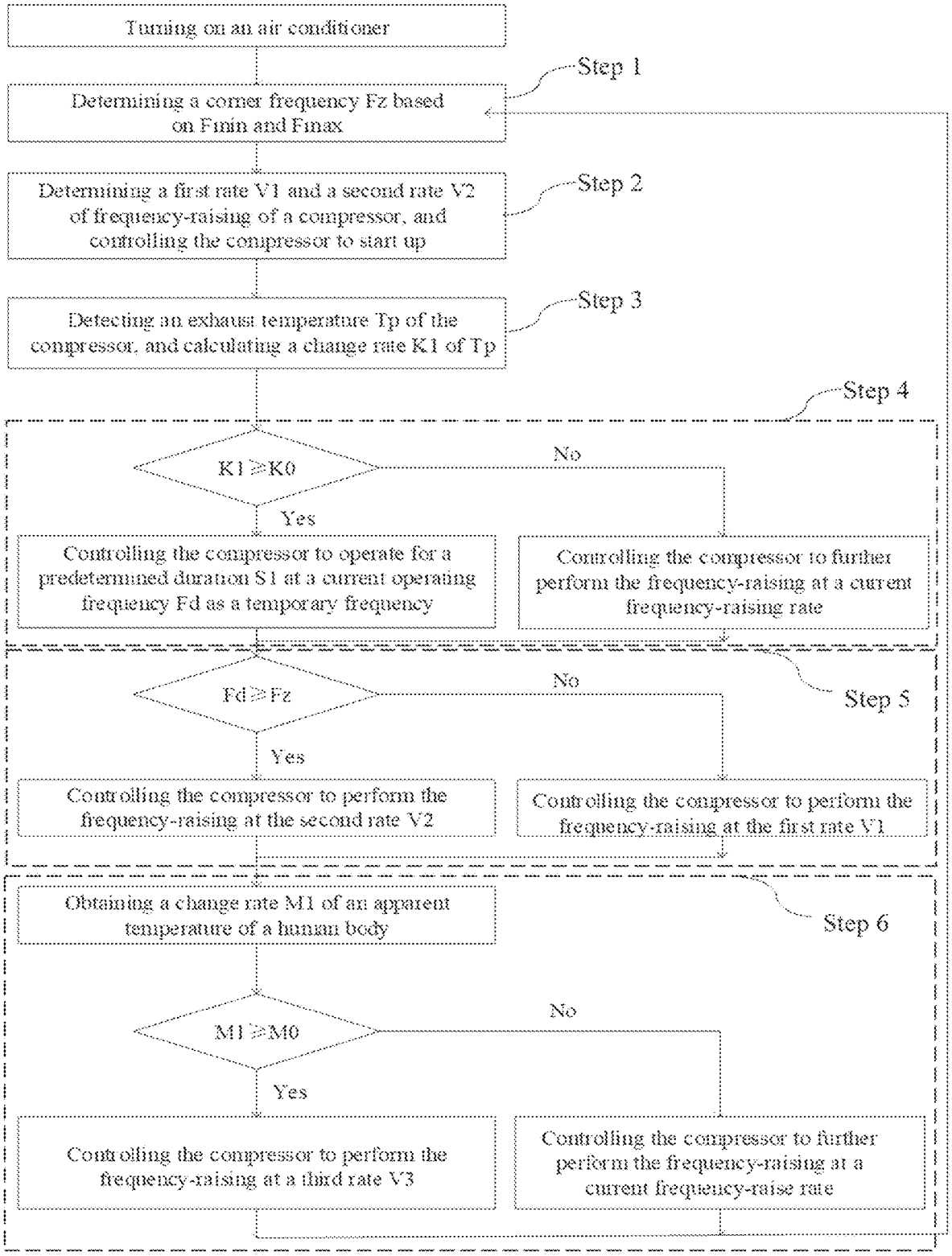
FIG. 4 is a flowchart of a control method for an air conditioner according to an embodiment of the present disclosure.

In some embodiments of the present disclosure, as shown in FIG. 4, the control method for the air conditioner 100 further includes: obtaining a change rate M1 of an apparent temperature of a human body; determining whether the change rate M1 of the apparent temperature is greater than or equal to a second predetermined value M0; controlling, in response to determining that the change rate M1 of the apparent temperature is greater than or equal to the second predetermined value M0, the compressor 5 to perform the frequency-raising at a third rate smaller than the current frequency-raising rate; and controlling, in response to determining that the change rate M1 of the apparent temperature is smaller than the second predetermined value M0, the compressor 5 to further perform the frequency-raising at the current frequency-raising rate.

It can be understood that since the change rate of the apparent temperature of the human body is related to the user's comfort, if M1 is greater than or equal to M0, it is indicated that the change rate of the apparent temperature of the human body is too fast and the comfort of the human body is poor. In this case, the compressor 5 is controlled to further preform the frequency-raising at the lower third rate in order to reduce the change rate of the apparent temperature of the human body to improve the user's comfort. Otherwise, it is indicated that the comfort of the human body is good, and the compressor 5 can maintain the current operation.

It should be noted that the current frequency-raising rate described above is the first or second rate at which the compressor 5 is performing the frequency-raising. For example, in a frequency-raising stage where the frequency-raising rate of the compressor 5 is the first rate, when the change rate M1 of the apparent temperature is greater than or equal to the second predetermined value M0, the compressor 5 is controlled to perform the frequency-raising at the third rate, and when the change rate M1 of the apparent temperature is smaller than the second predetermined value M0, the compressor 5 is controlled to further perform the frequency-raising at the first rate. For another example, in a frequency raising stage where the frequency-raising rate of the compressor 5 is the second rate, when the change rate M1 of the apparent temperature is greater than or equal to the second predetermined value M0, the compressor 5 is controlled to perform the frequency-raising at the third rate, and when the change rate M1 of the apparent temperature is smaller than the second predetermined value M0, the compressor 5 is controlled to further perform the frequency-raising at the second rate.

In one embodiment of the present disclosure, as shown in FIG. 4, a control method for an air conditioner 100 includes operations at steps 1 to 6.

At step 1, a corner frequency Fz of a compressor 5 is determined based on a target frequency Fmax of the compressor 5 and a minimum operating frequency Fmin of the compressor 5.

At step 2, a first rate V1 and a second rate V2 of frequency-raising of the compressor 5 are determined based on the corner frequency Fz, and the compressor 5 is controlled to start up.

At step 3, an exhaust temperature Tp of the compressor 5 is detected, and a change rate K1 of the exhaust temperature is calculated.

At step 4, when the change rate K1 of the exhaust temperature is greater than or equal to the first predetermined value K0, the compressor 5 is controlled to operate for a predetermined duration S1 at the current operating frequency Fd as a temporary frequency, and when the change rate K1 of the exhaust temperature is smaller than the first predetermined value K0, the compressor 5 is controlled to further perform the frequency-raising at the current frequency-raising rate.

At step 5, it is determined whether the current operating frequency Fd is greater than or equal to the corner frequency Fz. In response to determining that the current operating frequency Fd is greater than or equal to the corner frequency Fz, the compressor 5 is controlled to perform the frequency-raising to the target frequency Fmax at the second rate V2, and in response to determining that the current operating frequency Fd is smaller than the corner frequency Fz, the compressor 5 is controlled to perform the frequency-raising at the first rate V1. When the operating frequency of the compressor 5 is greater than the corner frequency Fz, the compressor 5 is controlled to perform the frequency-raising at the second rate V2.

At step 6, a change rate M1 of an apparent temperature of a human body is obtained in real-time, and it is determined whether the change rate M1 of the apparent temperature of the human body is greater than or equal to a second predetermined value M0. In response to determining that the change rate M1 of the apparent temperature of the human body is greater than or equal to the second predetermined value M0, the compressor 5 is controlled to perform the frequency-raising at the third rate V3, and in response to determining that the change rate M1 of the apparent temperature of the human body is smaller than the second predetermined value M0, the compressor 5 is controlled to further perform the frequency-raising at the current frequency-raising rate.

In some embodiments of the present disclosure, the second predetermined value ranges from 1 Celsius degree per second to 2 Celsius degrees per second. It can be understood that, it is possible to more accurately determine whether the change rate of the apparent temperature of the human body is too fast by setting the second predetermined value to range from 1 Celsius degree per second to 2 Celsius degrees per second. For example, in some examples of the present disclosure, the second predetermined value M0 may be 1.2 degrees per second, 1.4 degrees per second, 1.6 degrees per second, 1.8 degrees per second, or 2 degrees per second. In one embodiment, the second predetermined value M0 may be selected and set based on the model of the air conditioner 100 and its operating environment.

Figure 5:
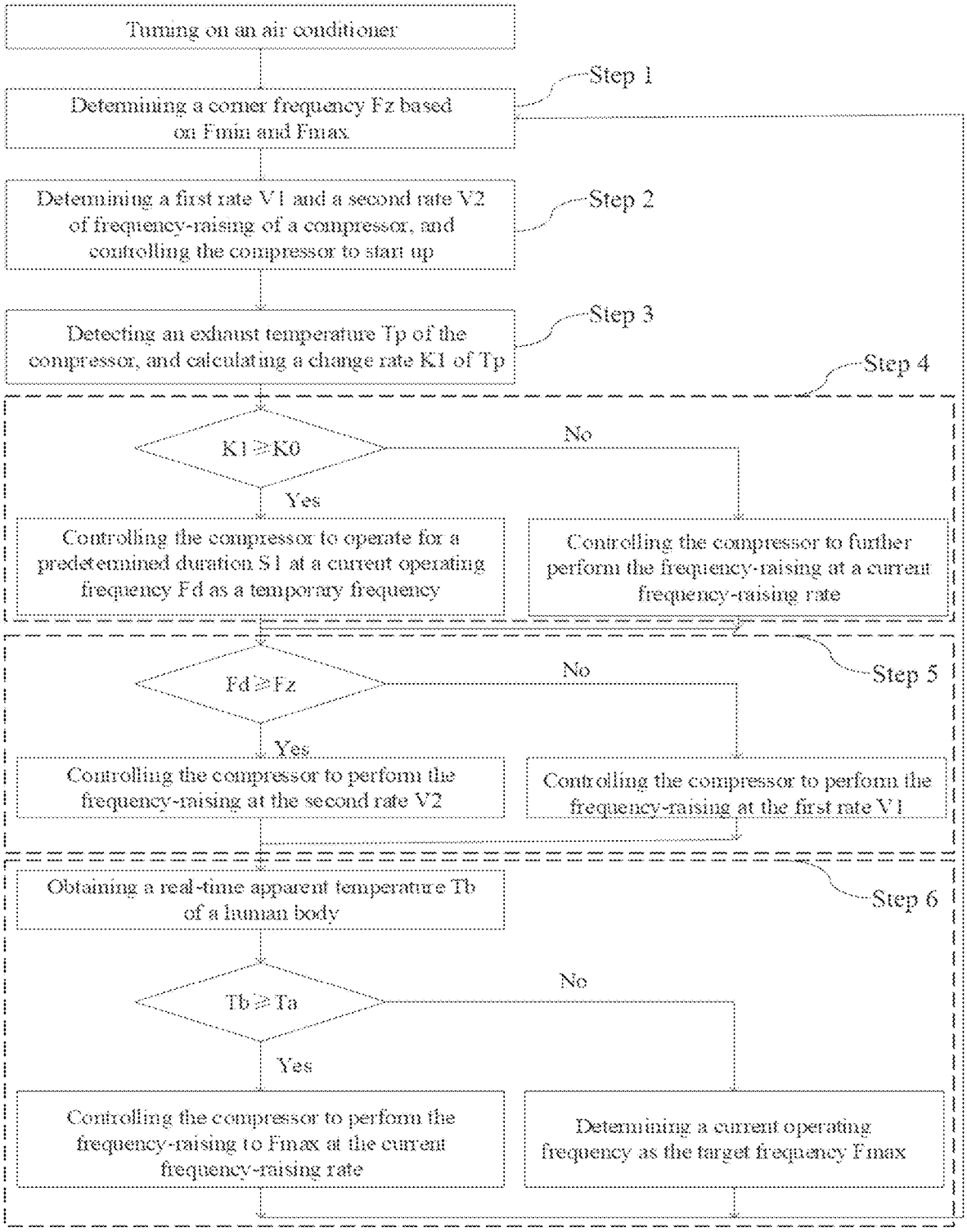
FIG. 5 is a flowchart of a control method for an air conditioner according to an embodiment of the present disclosure.

In some embodiments of the present disclosure, as shown in FIG. 5, the control method for the air conditioner 100 further includes: detecting a real-time apparent temperature Tb of the human body; determining whether the real-time apparent temperature Tb is greater than or equal to a target apparent temperature Ta; and enabling, in response to determining that the real-time apparent temperature Tb is greater than or equal to the target apparent temperature Ta, the compressor 5 to further perform the frequency-raising at the current frequency-raising rate; and determining, in response to determining that the real-time apparent temperature Tb is smaller than the target apparent temperature Ta, the current operating frequency of the compressor 5 as the target frequency of the compressor.

It can be understood that when the detected real-time apparent temperature of the human body is greater than or equal to the target apparent temperature, it is indicated that the indoor temperature is still high. At this time, it is necessary for the compressor 5 to further perform the frequency-raising to the target frequency rapidly. When the real-time apparent temperature of the human body detected by the compressor 5 is smaller than the target apparent temperature, it is indicated that the indoor temperature has lowered below the predetermined value. In this case, the refrigeration capacity of the compressor 5 has met the user's demands. Therefore, the operating frequency of the compressor 5 can be determined as the target frequency of the compressor 5, which can meet the user's refrigeration demands while relieving the reduction in energy efficiency caused by the continuous frequency-raising of the compressor 5.

In one embodiment of the present disclosure, as shown in FIG. 5, a control method for an air conditioner 100 includes operations at steps 1 to 6.

At step 1, a corner frequency Fz of a compressor 5 is determined based on a target frequency Fmax of the compressor 5 and a minimum operating frequency Fmin of the compressor 5.

At step 2, a first rate V1 and a second rate V2 of frequency-raising of the compressor 5 are determined based on the corner frequency Fz, and the compressor 5 is controlled to start up.

At step 3, an exhaust temperature Tp of the compressor 5 is detected, and a change rate K1 of the exhaust temperature is calculated.

At step 4, when the change rate K1 of the exhaust temperature is greater than or equal to the first predetermined value K0, the compressor 5 is controlled to operate for the predetermined duration S1 at the current operating frequency Fd as a temporary frequency, and when the change rate K1 of the exhaust temperature is smaller than the first predetermined value K0, the compressor 5 is controlled to further perform the frequency-raising at the current frequency-raising rate.

At step 5, it is determined whether the current operating frequency Fd is greater than or equal to the corner frequency Fz. In response to determining that the current operating frequency Fd is greater than or equal to the corner frequency Fz, the compressor 5 is controlled to perform the frequency-raising to the target frequency Fmax at the second rate V2, and in response to determining that the current operating frequency Fd is smaller than the corner frequency Fz, the compressor 5 is controlled to perform the frequency-raising at the first rate V1. When the operating frequency of the compressor 5 is greater than the corner frequency Fz, the compressor 5 is controlled to perform the frequency-raising at the second rate V2.

At step 6, an apparent temperature Tb of a human body is obtained in real-time, and it is determined whether the real-time apparent temperature Tb is greater than or equal to a target apparent temperature Ta. In response to determining that the real-time apparent temperature Tb is greater than or equal to the target apparent temperature Ta, the compressor 5 is enabled to further perform the frequency-raising to the target frequency Fmax at the current frequency-raising rate, and then the operation at step 1 is performed again. Further, in response to determining that the real-time apparent temperature Tb is smaller than the target apparent temperature Ta, the current operating frequency of the compressor 5 is determined as the target frequency Fmax of the compressor 5, and then the operation at step 1 is performed again.

In an embodiment of the present disclosure, as shown in FIG. 6, a control method for an air conditioner 100 includes operations at steps 1 to 10.

At step 1, an indoor ambient temperature T1 and an indoor relative humidity Rh are detected.

At step 2, a target apparent temperature Ta of a user is determined based on the indoor ambient temperature T1 and the indoor relative humidity Rh.

At step 3, a target frequency Fmax is determined based on the indoor ambient temperature T1 and the target apparent temperature Ta.

At step 4, half of a sum of the target frequency Fmax of a compressor 5 and a minimum operating frequency Fmin of the compressor 5 is determined as a corner frequency Fz of the compressor 5.

At step 5, a first rate V1 and a second rate V2 of frequency-raising of the compressor 5 are determined based on the corner frequency Fz, and the compressor 5 is controlled to start up.

At step 6, an exhaust temperature Tp of the compressor 5 is detected, and a change rate K1 of the exhaust temperature is calculated.

At step 7, when the change rate K1 of the exhaust temperature is greater than or equal to the first predetermined value K0, the compressor 5 is controlled to operate for a predetermined duration S1 at a current operating frequency Fd as a temporary frequency, and when the change rate K1 of the exhaust temperature is smaller than the first predetermined value K0, the compressor 5 is controlled to further perform the frequency-raising at the current frequency-raising rate.

At step 8, it is determined whether the current operating frequency Fd is greater than or equal to the corner frequency Fz. In response to determining that the current operating frequency Fd is greater than or equal to the corner frequency Fz, the compressor 5 is controlled to perform the frequency-raising to a target frequency Fmax at the second rate V2, and in response to determining that the current operating frequency Fd is smaller than the corner frequency Fz, the compressor 5 is controlled to perform the frequency-raising at the first rate V1. When the operating frequency of the compressor 5 is greater than the corner frequency Fz, the compressor 5 is controlled to perform the frequency-raising at the second rate V2.

At step 9, a change rate M1 of an apparent temperature of a human body is obtained in real-time, and it is determined whether the change rate M1 of the apparent temperature is greater than or equal to a second predetermined value M0. In response to determining that the change rate M1 of the apparent temperature is greater than or equal to the second predetermined value M0, the compressor 5 is controlled to perform the frequency-raising at a third frequency V3, and or in response to determining that the change rate M1 of the apparent temperature is smaller than the second predetermined value M0, the compressor 5 is controlled to further perform the frequency-raising at the current frequency-raising rate.

At step 10, a real-time apparent temperature Tb of the human body is detected, and it is determined whether the real-time apparent temperature Tb is greater than or equal to a target apparent temperature Ta. In response to determining that the real-time apparent temperature Tb is greater than or equal to the target apparent temperature Ta, the compressor 5 is enabled to further perform the frequency-raising to the target frequency Fmax at the current frequency-raising rate, and then operation at step 1 is performed again. In addition, in response to determining that the real-time apparent temperature Tb is smaller than the target apparent temperature Ta, the current operating frequency of the compressor 5 is determined as the target frequency Fmax of the compressor 5, and then the operation at step 1 is performed again.

An air conditioner 100 according to embodiments of the present disclosure will be described below with reference to the accompanying drawings.

The air conditioner 100 according to the embodiment of the present disclosure is capable of operating based on the control method for the air conditioner 100 described above.

According to the air conditioner 100 of the embodiment of the present disclosure, when the current operating frequency of the compressor 5 is smaller than the corner frequency, the compressor 5 is in a low-and-medium frequency operating state, and an air conditioner 100 has a relatively low pressure when the compressor 5 operates at a low-and-medium frequency. In this case, the frequency-raising can be performed at a faster first rate. When the current operating frequency of the compressor 5 is greater than the corner frequency, the compressor 5 is in a high frequency operating state, and the air conditioner 100 has a relatively high pressure when the compressor 5 operates at a high frequency. In this case, the frequency-raising can be performed at a slower second rate. In this way, the startup time of the compressor 5 can be shortened while the air conditioner 100 is ensured to operate safely and stably. Therefore, the operating frequency of the compressor 5 can be promptly increased to the target frequency, thereby realizing a rapid adjustment of an indoor temperature, which in turn improves user's comfort.

Figure 9:
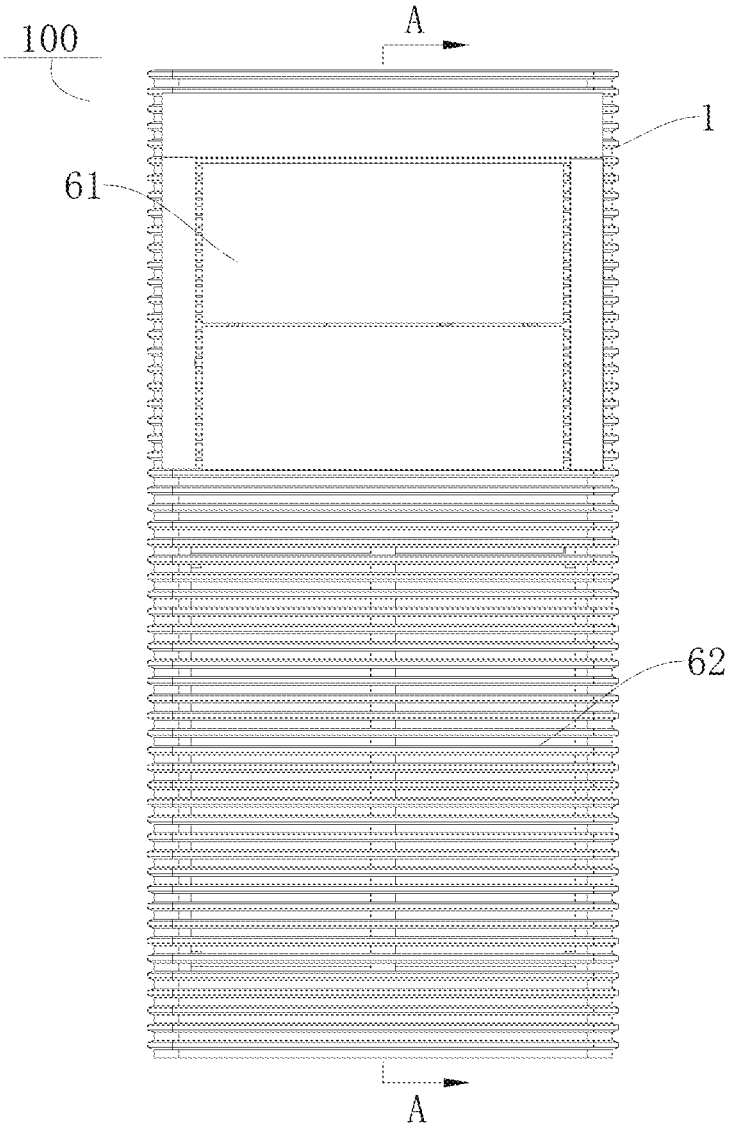
FIG. 9 is a front view of an air conditioner according to an embodiment of the present disclosure.
Figure 10:
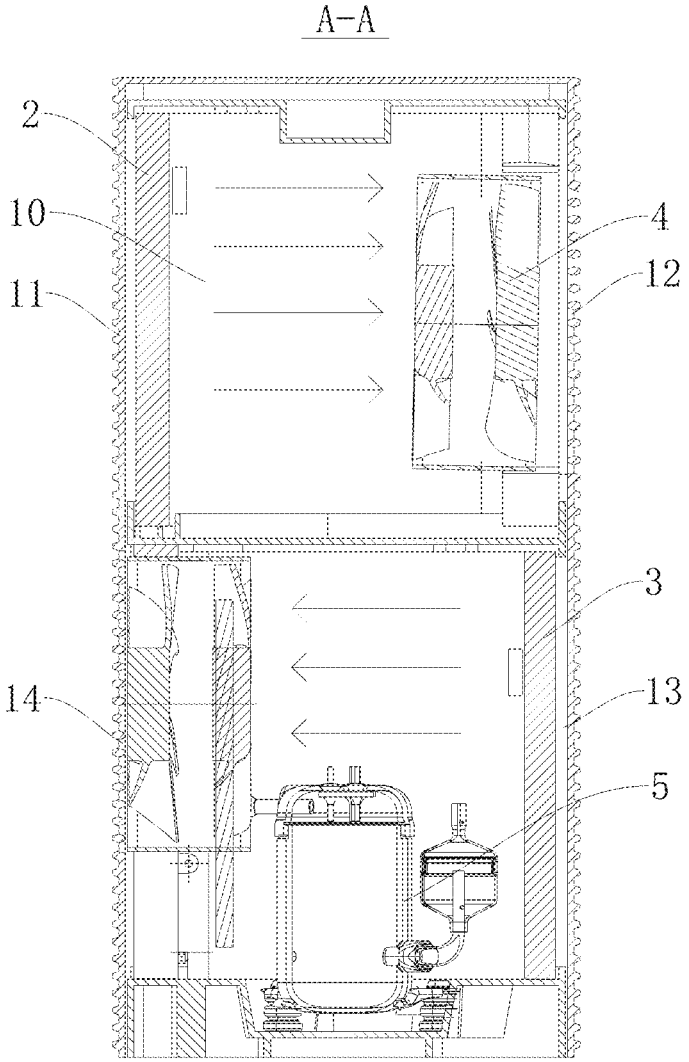
FIG. 10 is a cross-sectional view taken along line A-A in FIG. 9.
Figure 11:
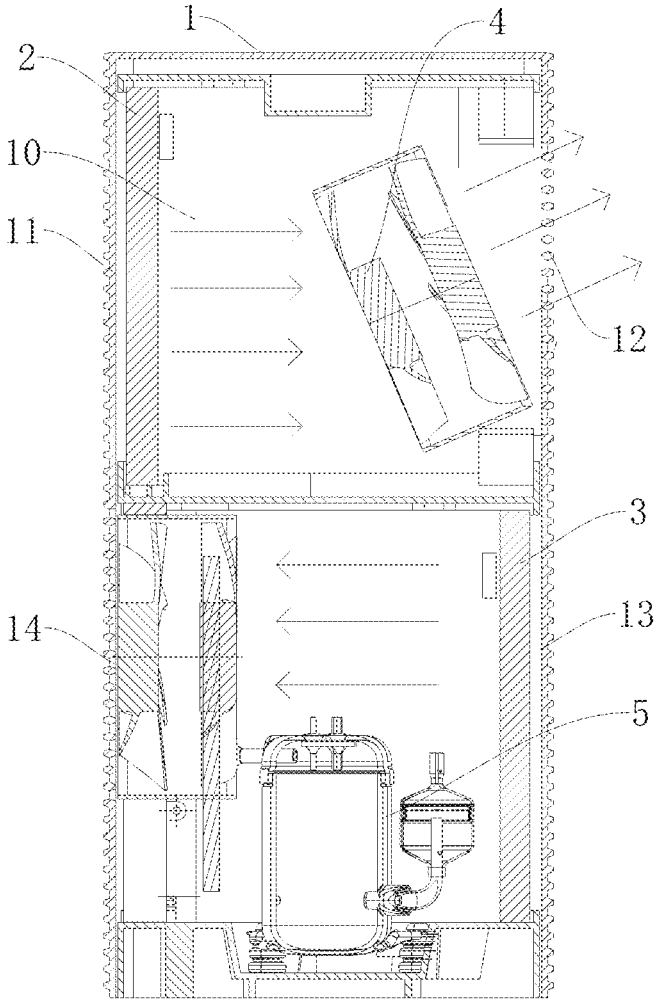
FIG. 11 is a cross-sectional view of an air conditioner according to an embodiment of the present disclosure.

In one embodiment of the present disclosure, as shown in FIGS. 9 to 11, the air conditioner 100 includes a housing 1, an evaporator 2, a condenser 3, a fan assembly 4, a compressor 5, and a throttling device. A divided accommodation space 10 is formed by the housing 1. The evaporator 2, the condenser 3, the fan assembly 4, the compressor 5, and the throttling device are all disposed in the accommodation space 10. In addition, the evaporator 2 and the condenser 3 are located in an upper accommodation space and a lower accommodation space of the divided accommodation space 10. The evaporator 2 and the condenser 3 are both designed into an arc-shape. The compressor 5 is interposed between the evaporator 2 and the condenser 3. An end of the compressor 5 is in communication with an end of the evaporator 2, and the other end of the compressor 5 is in communication with an end of the condenser 3. The throttling device is interposed between the evaporator 2 and the condenser 3. An end of the throttling device is in communication with the other end of the evaporator 2, and the other end of the throttling device is in communication with the other end of the condenser 3.

As shown in FIGS. 9 to 11, the housing 1 has a first air inlet 11, a first air outlet 12, a second air inlet 13, and a second air outlet 14. The first air inlet 11 is in communication with an indoor space, and arranged opposite to the evaporator 2. The first air outlet 12 is in communication with the indoor space, and arranged opposite to the evaporator 2. A deflector 16 is disposed at the first air outlet 12. The second air inlet 13 is in communication with the indoor space, and arranged opposite to the condenser 3. An air inlet grille 62 is disposed at the second air inlet 13. The second air outlet 14 is in communication with an outdoor space, and arranged opposite to the condenser 3. In one embodiment of the present disclosure, an airflow can enter the accommodation space 10 through the first air inlet 11, flow through the evaporator 2, and then be blown into the indoor space from the first air outlet 12 by the driving of the fan assembly 4 after performing heat exchange with the evaporator 2. The indoor air can also enter the accommodation space 10 through the second air inlet 13, and flow through the condenser 3, and then be discharged to the outdoor space from the second air outlet 14 after performing heat exchange with the condenser 3.

In one embodiment, as shown in FIGS. 9 to 11, the fan assembly 4 is arranged at a side of the evaporator 2 adjacent to the first air outlet 12. The fan assembly 4 includes a motor, a fan impeller, and a bracket. The bracket is mounted on the housing 1 and rotatable relative to the housing 1. When the air conditioner 100 is turned on, the bracket can rotate by a predetermined angle to allow the airflow to be blown upwards. The fan impeller may be a counter-rotating fan impeller.

The air conditioner 100 can include a controller that includes a hardware processor. A control program stored in a memory is executable by the hardware processor to implement the control method for controlling the air conditioner as described above.

According to another aspect of the present disclosure, a computer readable storage medium is provided. A control program is stored in the computer readable storage medium, and is executable by a hardware processor to implement the control method for controlling the air conditioner as described above.

In the present disclosure, unless otherwise explicitly specified and limited, the terms "installed", "connected", "coupled", "fixed", and other terms should be understood in a broad sense. For example, they can be fixed connections, removable connections, or formed integrally; it can be directly or indirectly connected through intermediate media, or it can be the internal connection between two components or the interaction relationship between two components. For those skilled in the art, the specific meaning of the above terms in the present disclosure can be understood based on specific circumstances.

In the description of this specification, the reference to the terms "one embodiment", "some embodiments", "examples", "specific examples", or "some examples" means that the specific features, structures, materials, or features described in connection with the embodiment or example are included in at least one embodiment or example of the present disclosure. In this specification, schematic representations of the above terms do not necessarily refer to the same embodiments or examples. Moreover, the specific features, structures, materials, or features described may be combined in an appropriate manner in any one or more embodiments or examples. In addition, those skilled in the art can combine and combine the different embodiments or examples described in this specification and the features of different embodiments or examples without contradicting each other.

Although embodiments of the present disclosure have been shown and described, those skilled in the art can understand that various changes, modifications, substitutions, and changes can be made to these embodiments without departing from the principles and sprits of the present disclosure. The scope of the present disclosure is defined by the claims and their equivalents.

What is claimed is:

1. A control method for an air conditioner, comprising:

determining a corner frequency of a compressor based on a target frequency of the compressor and a minimum operating frequency of the compressor;

determining, based on the corner frequency, a first rate and a second rate of frequency-raising of the compressor; and controlling the compressor to start up, wherein the compressor performs the frequency-raising at the first rate when a current operating frequency of the compressor is smaller than the corner frequency, and wherein the compressor performs the frequency-raising at the second rate when the current operating frequency of the compressor is greater than or equal to the corner frequency, wherein the first rate is greater than the second rate, and wherein the corner frequency is half of a sum of the target frequency and the minimum operating frequency.

2. The control method for the air conditioner according to claim 1, further comprising:

detecting an indoor ambient temperature and an indoor relative humidity;

determining a target apparent temperature of a user based on the indoor ambient temperature and the indoor relative humidity; and determining the target frequency based on the indoor ambient temperature and the target apparent temperature.

3. An air conditioner comprising a controller, wherein the controller comprises a hardware processor; and wherein a control program stored in a memory is executable by the hardware processor to implement the control method according to claim 1 for controlling the air conditioner.

4. A non-transitory computer readable storage medium, wherein a control program is stored in the computer readable storage medium, wherein the control program is executable by a hardware processor to implement the control method for an air conditioner according to claim 1.

5. A control method for the air conditioner, comprising:

determining a corner frequency of a compressor based on a target frequency of the compressor and a minimum operating frequency of the compressor;

determining, based on the corner frequency, a first rate and a second rate of frequency-raising of the compressor; and controlling the compressor to start up, wherein the compressor performs the frequency-raising at the first rate when a current operating frequency of the compressor is smaller than the corner frequency, and wherein the compressor performs the frequency-raising at the second rate when the current operating frequency of the compressor is greater than or equal to the corner frequency, wherein the first rate is greater than the second rate, and wherein the control method further comprises:

detecting an exhaust temperature of the compressor;

calculating a change rate of the exhaust temperature;

controlling, when the change rate of the exhaust temperature is greater than or equal to a first predetermined value, the compressor to operate at the current operating frequency as a temporary frequency for a predetermined duration; and controlling, when the change rate of the exhaust temperature is smaller than the first predetermined value, the compressor to further perform the frequency-raising at a current frequency-raising rate.

6. The control method for the air conditioner according to claim 5, wherein the first predetermined value ranges from 4 Celsius degrees per second to 8 Celsius degrees per second.

7. The control method for the air conditioner according to claim 5, wherein the predetermined duration ranges from 50 seconds to 70 seconds.

8. The control method for the air conditioner according to claim 5, further comprising:

determining whether the current operating frequency is greater than or equal to the corner frequency;

controlling, in response to determining that the current operating frequency is greater than or equal to the corner frequency, the compressor to further perform the frequency-raising at the second rate; and controlling, in response to determining that the current operating frequency is smaller than the corner frequency, the compressor, the compressor to further perform the frequency-raising at the first rate.

9. The control method for the air conditioner according to claim 8, further comprising:

obtaining a change rate of an apparent temperature of a human body;

determining whether the change rate of the apparent temperature is greater than or equal to a second predetermined value;

controlling, in response to determining that the change rate of the apparent temperature is greater than or equal to the second predetermined value, the compressor to further perform the frequency-raising at a third rate, the third rate being smaller than the current frequency-raising rate; and controlling, in response to determining that the change rate of the apparent temperature is smaller than the second predetermined value, the compressor to further perform the frequency-raising at the current frequency-raising rate.

10. The control method for the air conditioner according to claim 9, wherein the second predetermined value ranges from 1 Celsius degree per second to 2 Celsius degrees per second.

11. The control method for the air conditioner according to claim 8, further comprising:

detecting a real-time apparent temperature of a human body;

determining whether the real-time apparent temperature is greater than or equal to a target apparent temperature;

enabling, in response to determining that the real-time apparent temperature is greater than or equal to the target apparent temperature, the compressor to further perform the frequency-raising at the current frequency-raising rate; and determining, in response to determining that the real-time apparent temperature is smaller than the target apparent temperature, the current operating frequency of the compressor as the target frequency of the compressor.

12. An air conditioner comprising a controller, wherein the controller comprises a hardware processor; and wherein a control program stored in a memory is executable by the hardware processor to implement the control method according to claim 5 for controlling the air conditioner.

13. A non-transitory computer readable storage medium, wherein a control program is stored in the computer readable storage medium, wherein the control program is executable by a hardware processor to implement the control method for an air conditioner according to claim 5.

* * * * *